US009272481B2

(12) United States Patent
Yeager

(10) Patent No.: US 9,272,481 B2
(45) Date of Patent: Mar. 1, 2016

(54) BOTTOM-GUSSETED PACKAGE AND METHOD

(71) Applicant: Innoflex Incorporated, Mobile, AL (US)

(72) Inventor: James W. Yeager, Mobile, AL (US)

(73) Assignee: Innoflex Incorporated, Birmingham, AL (US)

( * ) Notice: Subject to any disclaimer, the term of this patent is extended or adjusted under 35 U.S.C. 154(b) by 0 days.

(21) Appl. No.: 14/034,154

(22) Filed: Sep. 23, 2013

(65) Prior Publication Data

US 2014/0161373 A1 Jun. 12, 2014

Related U.S. Application Data

(60) Provisional application No. 61/734,114, filed on Dec. 6, 2012.

(51) Int. Cl.

*B65D 30/16* (2006.01)
*B31B 29/00* (2006.01)
*B65D 33/25* (2006.01)
(Continued)

(52) U.S. Cl.

CPC ..... *B31B 29/00* (2013.01); *B31B 37/00* (2013.01); *B65B 9/2056* (2013.01); *B65B 9/213* (2013.01); *B65B 61/188* (2013.01); *B65D 33/2533* (2013.01); *B65D 75/5883* (2013.01); *B31B 2219/9022* (2013.01); *B31B 2219/9051* (2013.01); *B31B 2221/50* (2013.01); *B31B 2237/20* (2013.01)

(58) Field of Classification Search

CPC ..... B65D 75/008
USPC ..... 383/104, 61.2, 210–211, 63, 906, 122, 383/203, 62, 36, 59
See application file for complete search history.

(56) References Cited

U.S. PATENT DOCUMENTS 4,651,504 A * 3/1987 Bentsen ..... 53/452
5,826,401 A * 10/1998 Bois ..... 53/412
(Continued)

FOREIGN PATENT DOCUMENTS

JP 2004161288 A * 6/2004 ..... B65D 30/16
JP 2004203393 A * 7/2004 ..... B65D 30/16
(Continued)

OTHER PUBLICATIONS

Machine translation of Japanese Document No. 2012-152901. Translated on Feb. 5, 2015.*
(Continued)

*Primary Examiner* — Jes F Pascua
(74) *Attorney, Agent, or Firm* — Wood, Phillips, Katz, Clark & Mortimer

(57) ABSTRACT

A bottom-gusseted package comprises a package body, and a bottom gusset positioned transversely of a longitudinal axis of the package body. A top sleeve portion of the package body can be configured to include a recloseable fastener, a dispensing spout, or an upper package seal. Formation of the bottom-gusseted package is effected by positioning individual sleeves transversely of the longitudinal axis of a flexible web which forms the package body. During package formation, the flexible web is cut to form individual packages, and each individual sleeve can be cut to form a bottom gusset in one package, and a top sleeve portion in an adjacent package.

12 Claims, 14 Drawing Sheets

(51) Int. Cl.

| | |
|---|---|
| ***B31B 37/00*** | (2006.01) |
| ***B65B 61/18*** | (2006.01) |
| ***B65B 9/20*** | (2012.01) |
| ***B65B 9/213*** | (2012.01) |
| ***B65D 75/58*** | (2006.01) |

(56) References Cited

U.S. PATENT DOCUMENTS

| | | | | |
|---|---|---|---|---|
| 6,286,191 | B2 * | 9/2001 | Van Erden | 24/399 |
| 6,719,678 | B1 * | 4/2004 | Stern | B65D 33/2508 493/212 |
| 6,783,276 | B2 * | 8/2004 | Machacek et al. | 383/36 |
| 6,928,791 | B2 * | 8/2005 | Ausnit | 53/412 |
| 2007/0092166 | A1 * | 4/2007 | Anzini et al. | 383/63 |

FOREIGN PATENT DOCUMENTS

| | | | | |
|---|---|---|---|---|
| JP | 2010105741 | A | * | 5/2010 |
| JP | 2012152901 | A | * | 8/2012 |

OTHER PUBLICATIONS

International Search Report and Written Opinion for corresponding PCT application No. PCT/US14/56729.

* cited by examiner

BOTTOM-GUSSETED PACKAGE AND METHOD

TECHNICAL FIELD

The present invention relates generally to packages formed from polymeric film webs, and more particularly to a bottom-gusseted package including a bottom gusset positioned transversely of a longitudinal axis of the package, with the configuration of the package, and its method of formation, permitting use with associated form, fill, and seal equipment.

BACKGROUND OF THE INVENTION

Packages formed from plastic, polymeric film material have found widespread application in the market place for convenient and efficient packaging of all manner of food and non-food products. Packages of this nature typically are formed by folding and sealing a web of polymeric material to form a package body having front and rear package panels, with the package panels joined to each other at margins thereof. Depending upon the method of formation, the front and rear package panels may be joined to each other either by folded portions of the package body, or at seals (typically heat seals) joining the package panels to each other.

Non-gusseted packages of this type are sometimes referred to as "pillow packs", and do not include either side gussets or top or bottom gussets. However, for many applications it is desirable to form a gusseted package that is, providing the package with inwardly-extended, pleat-like gussets at one or more margins of the package body. For example, side-gusseted packages include inwardly extending side gussets at opposite lateral sides of the package body, which side gussets join respect lateral edges of the front and rear package panels to each other.

For some applications, it is especially desirable to provide a bottom-gusseted package, that is, a package having an inwardly extending gusset at the bottom of the package body. By virtue of the breadth and stability provided by the bottom gusset, packages of this nature can frequently be configured to be self-standing, promoting efficient display for consumer selection.

Heretofore, bottom-gusseted packages have typically been formed by pleating a web of polymeric material in a direction parallel to the longitudinal axis of the web. Suitable ploughs and forming guides shape and configure the polymeric web as it moves longitudinally, including formation of a continuous, inwardly extending bottom gusset in the web material. Subsequently, suitable seals are formed transversely of the web to define individual package bodies, each including front and rear package panels, with each including a bottom gusset. Individual package bodies are formed by cutting the web of material at the transversely extending seals, with the contents of each package deposited therein either before or after cutting of the web into individual packages. Formation of an upper seal, at the margin of the folded polymeric web opposite the bottom gusset, closes and seals each package body.

As will be appreciated by this typical formation technique, the height or vertical dimension of each package body is approximately equal to one-half of the width of the polymeric web, less the dimension of the bottom gusset. As a consequence, the maximum height of any package being formed is essentially limited by the maximum width of the web of polymeric material which the forming equipment is capable of handling.

The present invention contemplates a bottom-gusseted package, and a method of formation, which addresses the shortcomings in the conventional forming of bottom-gusseted package. In essence, this is achieved by forming each package with a bottom gusset positioned transversely of the longitudinal axes of the polymeric film web and each package. The bottom-gusseted packages of any selected height can be readily and efficiently formed.

SUMMARY OF THE INVENTION

A bottom-gusseted package embodying the principles of the present invention comprises a package body formed from a flexible web having a longitudinal axis. The flexible web is folded to define a front package panel and a rear package of the package body. The front and rear package panels are joined to each other at respective lateral side margins of the package body, with the flexible web being joined to itself along a seam which extends parallel to the longitudinal axis of the flexible web.

Notably, a package formed in accordance with the present invention includes a bottom gusset positioned between the front and rear package panels, with the bottom gusset extending upwardly and inwardly from the lower edges of the front and rear package panels. By formation of the present package in accordance with the present invention, the bottom gusset is positioned within the package body transversely of the longitudinal axis of the package body, and transversely of the longitudinal axis of the flexible web from which the package body is formed. As a consequence, a package body can be very efficiently formed at any selected height, without necessarily being limited by the width of the flexible web from which the package is formed.

Notably, the versatility of the method of package formation in accordance with the present invention permits formation of a bottom-gusseted package in different configurations. In one illustrated embodiment, a bottom-gusseted package is formed which includes a recloseable fastener assembly at the upper portion of the package. In alternative embodiments, a bottom-gusseted package is formed with an a top sleeve portion generally opposite the bottom gusset, wherein the top sleeve portion can be configured to include an invertible dispensing spout positioned within the package body, or an upper package seal. However, it is within the purview of the present invention that the invention be practiced for forming packages with a bottom gusset only, without a top sleeve portion.

The method of formation of a bottom-gusseted package in accordance with the present invention comprises the steps of providing flexible web of material having a longitudinal axis. Suitable polymeric material can be employed by virtue of its liquid-impermeable characteristics, and heat-sealing capabilities.

Together with a flexible web of material, the present method contemplates that a flexible, sleeve-forming web is provided. The sleeve-forming web is folded and generally tubular, and can be configured to include a series of recloseable fastener assemblies, a series of upper package seal, or a series of invertible dispensing spouts. It is presently preferred that an inside surface of the folded, sleeve-forming web does not heat-seal to itself, thus facilitating formation of a bottom gusset which spreads or opens to permit the packages being formed to be generally self-standing. Depending upon the specific application, it can be desirable to form the sleeve-forming web from material which is different that the material of the flexible web.

The present method further comprises the step of cutting the flexible, sleeve-forming web into a plurality of individual sleeves, each having a folded, generally tubular configuration. The individual sleeves are next joined to the flexible web in spaced apart relationship longitudinally of the flexible web, transversely of the longitudinal axis of the flexible web. The spacing between individual sleeves corresponds to the length of each of the bottom-gusseted packages being formed. Notably, as will be further described, in the illustrated embodiments each individual sleeve eventually forms the bottom gusset of one package, and the top sleeve portion of an adjacent one of the packages being formed.

After the individual sleeves are joined to the flexible web, the flexible web is folded and joined along lateral margins thereof to form a generally tubular, folded flexible web. The individual sleeves are positioned generally within the folded flexible web, in spaced apart relationship.

Folding of the flexible web material forms a package body for each of the bottom-gusseted packages, with each package body including a front package panel and a rear package panel joined at opposite side margins thereof. The individual sleeves are positioned generally within the folded, flexible web.

Next, the folded flexible web is cut at intervals each corresponding in length to the length of each of the bottom-gusseted packages being formed. By this cutting step individual packages are formed so that each individual sleeve provides a bottom gusset for each one of the packages.

In the illustrated embodiments, the cutting step includes cutting through each of the individual sleeves positioned within the folded flexible said cutting step includes cutting through each of said individual sleeves so that a portion of each individual sleeve provides: (1) the bottom gusset for one of the packages being formed, and (2) a top sleeve portion for an adjacent one of said packages being formed.

By the present invention each of the individual sleeves can be provided with a length which is less than the width of the folded web of flexible material. This facilitates formation of the bottom gusset with a width less than the width of the package, which desirably permits formation of side seals between the front and read package panels of each said package at opposite side edges of the bottom gusset of the package. Such side seals can be formed of a sufficient width to permit the package to be readily self-standing and stable.

In accordance with the illustrated embodiments, the present method includes joining each of the individual sleeves to the folded flexible web prior to the step of cutting the folded flexible web.

In accordance with one illustrated embodiment, each top sleeve portion is provided with a recloseable fastener positioned within the respective top sleeve portion. Each recloseable fastener comprises a pair of fastening elements respectively joined to confronting inside surfaces of each top sleeve portion. The fastener elements may comprises profile fastener elements, adhesive fastener components, hook-and-loop style fastener components, "unisex" self-engaging fastener components, and other releasable fastener arrangements as are known in the art.

In one alternate illustrated embodiment, each top sleeve portion defines an invertible dispensing spout through which the contents of the respective bottom-gusseted package can be dispensed by inversion of the top sleeve portion outwardly of the respective package body. In this embodiment, the invertible dispensing spout is positioned within the associated package body at an end thereof generally opposite the bottom gusset. The dispensing spout is provided in the form of the folded, top sleeve portion, with the dispensing spout initially positioned within the package body so that a spout portion of the dispensing spout extends inwardly of the package body generally toward the bottom gusset. This is the configuration in which the package is initially formed. After the package is filled and sealed, the dispensing spout is invertible by squeezing or compressing the package so that the spout portion thereof extends generally outwardly of the package body for dispensing contents from within the package.

In another alternate embodiment, each top sleeve portion is provided with an upper seal for closing a respective one of the packages being formed. In the presently preferred practice of this embodiment, the upper seal is formed between inturned edges of the respective top sleeve portion.

Other features and advantages of the present invention will become readily apparent from the following detailed description, the accompanying drawings, and the appended claims.

Figure 5:
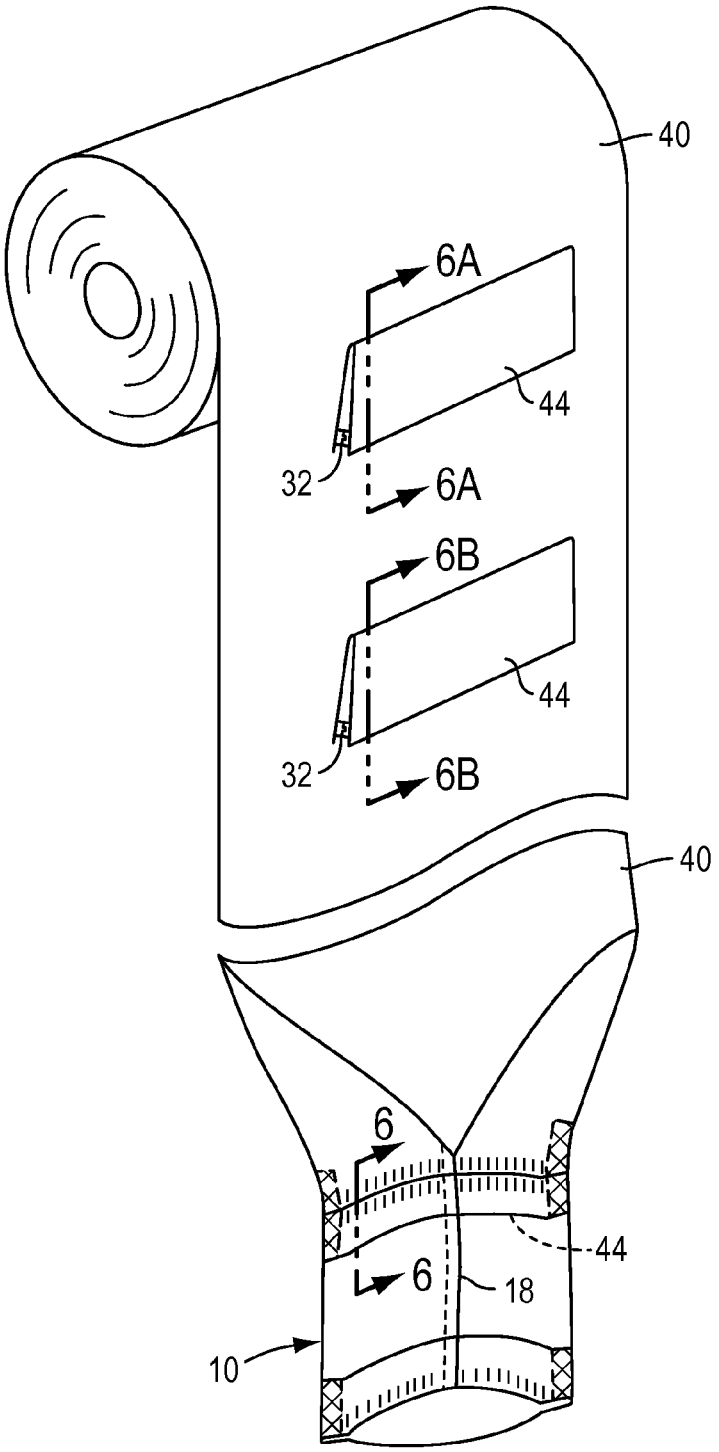
FIG. 5 is a diagrammatic view further illustrating formation of a recloseable, bottom-gusseted package.
Figure 6:
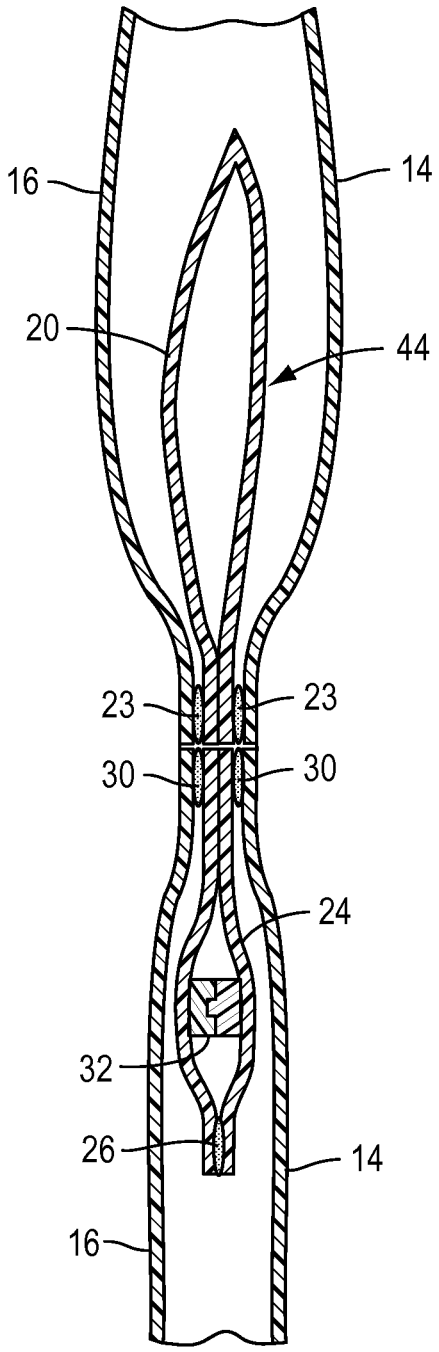
FIG. 6 is a cross-sectional view taken generally along lines 6-6 of FIG. 5.
Figure 7:
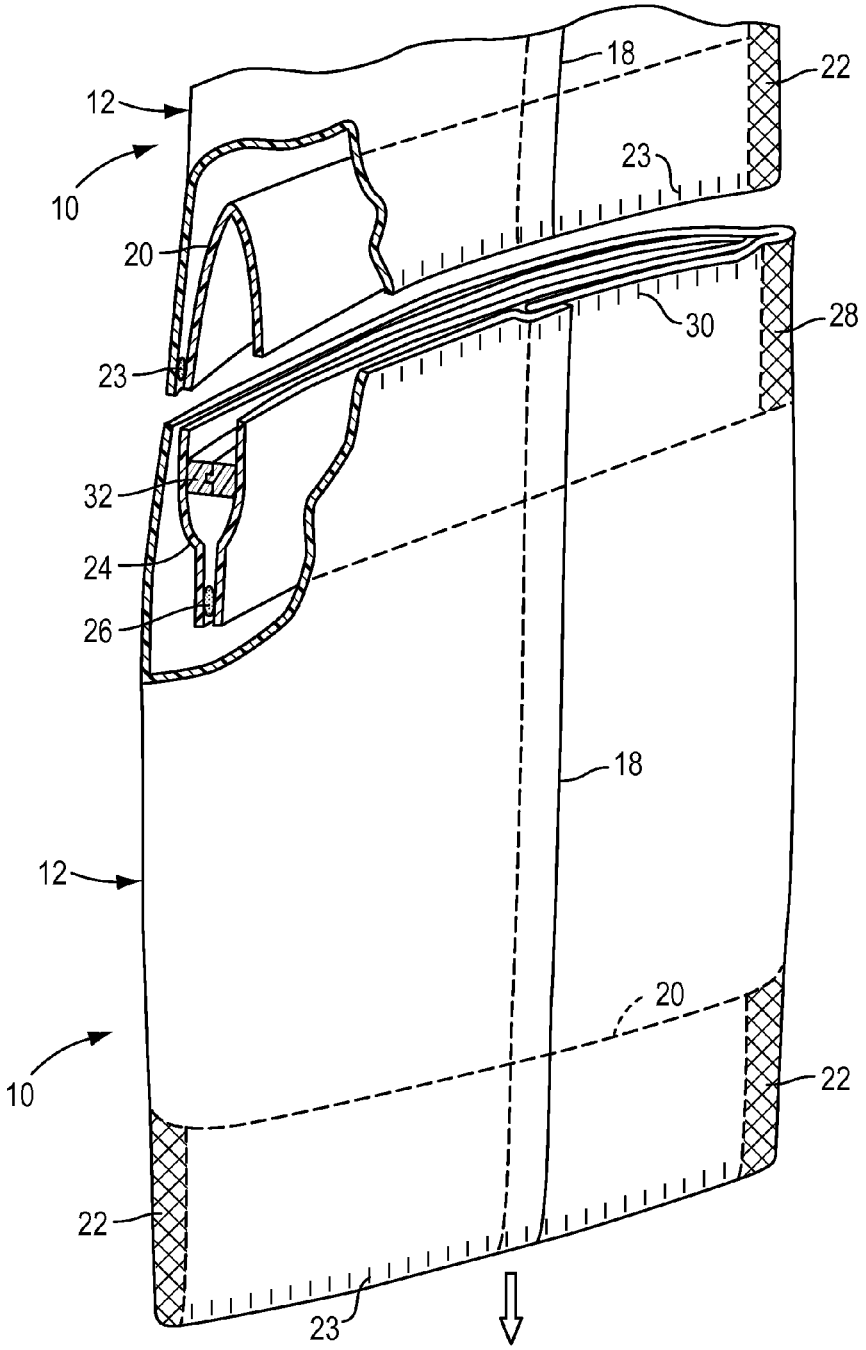
Figure 8:
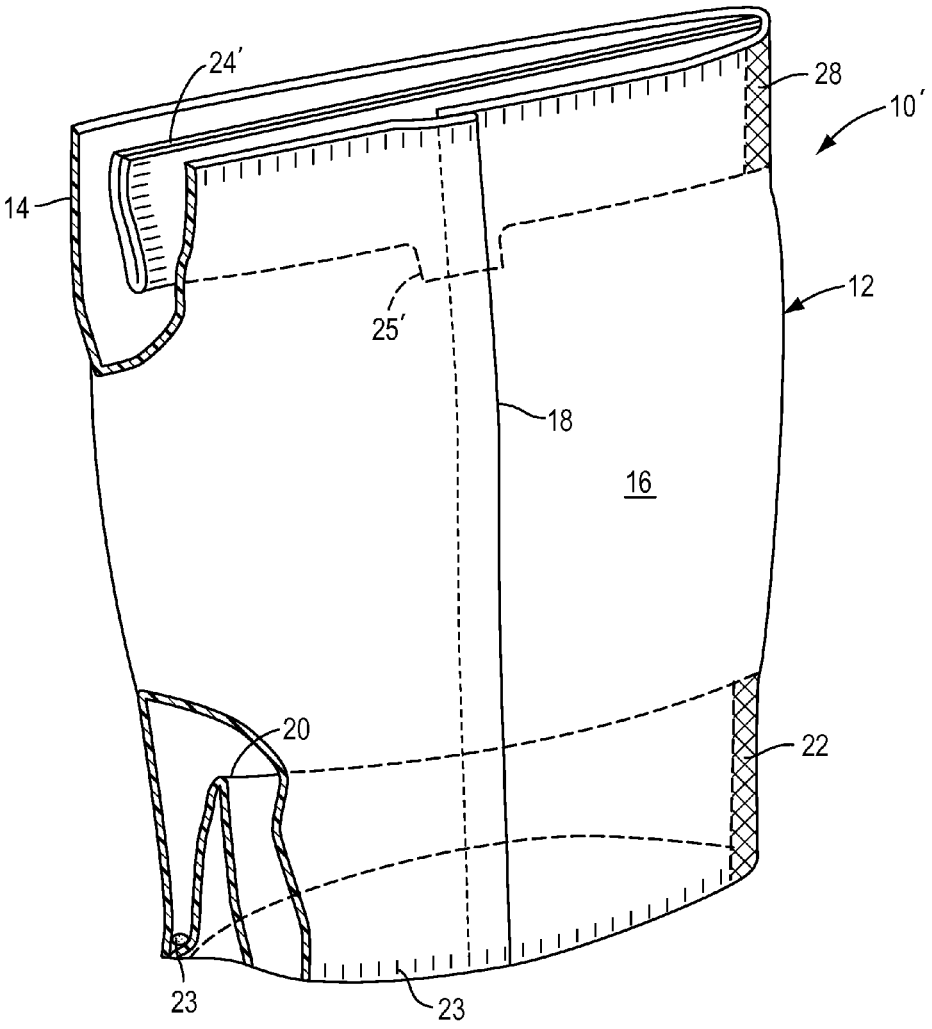
Figure 10:
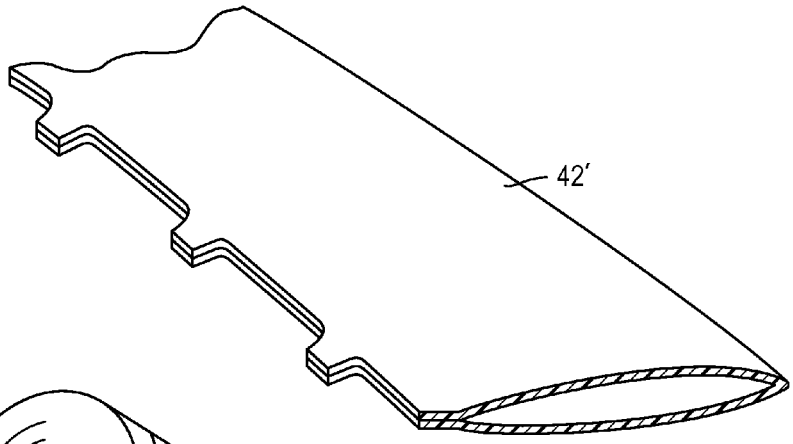
Figure 9:
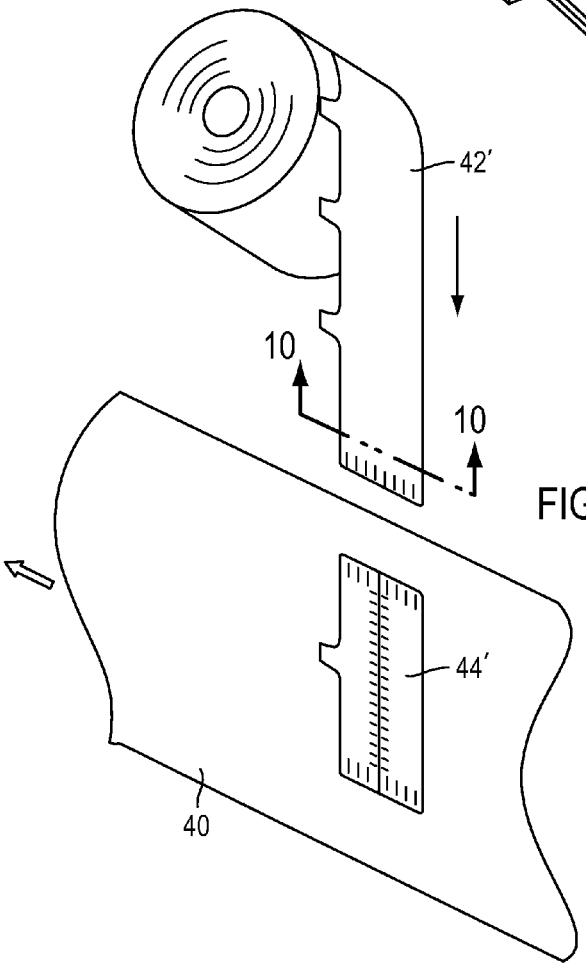
Figure 11:
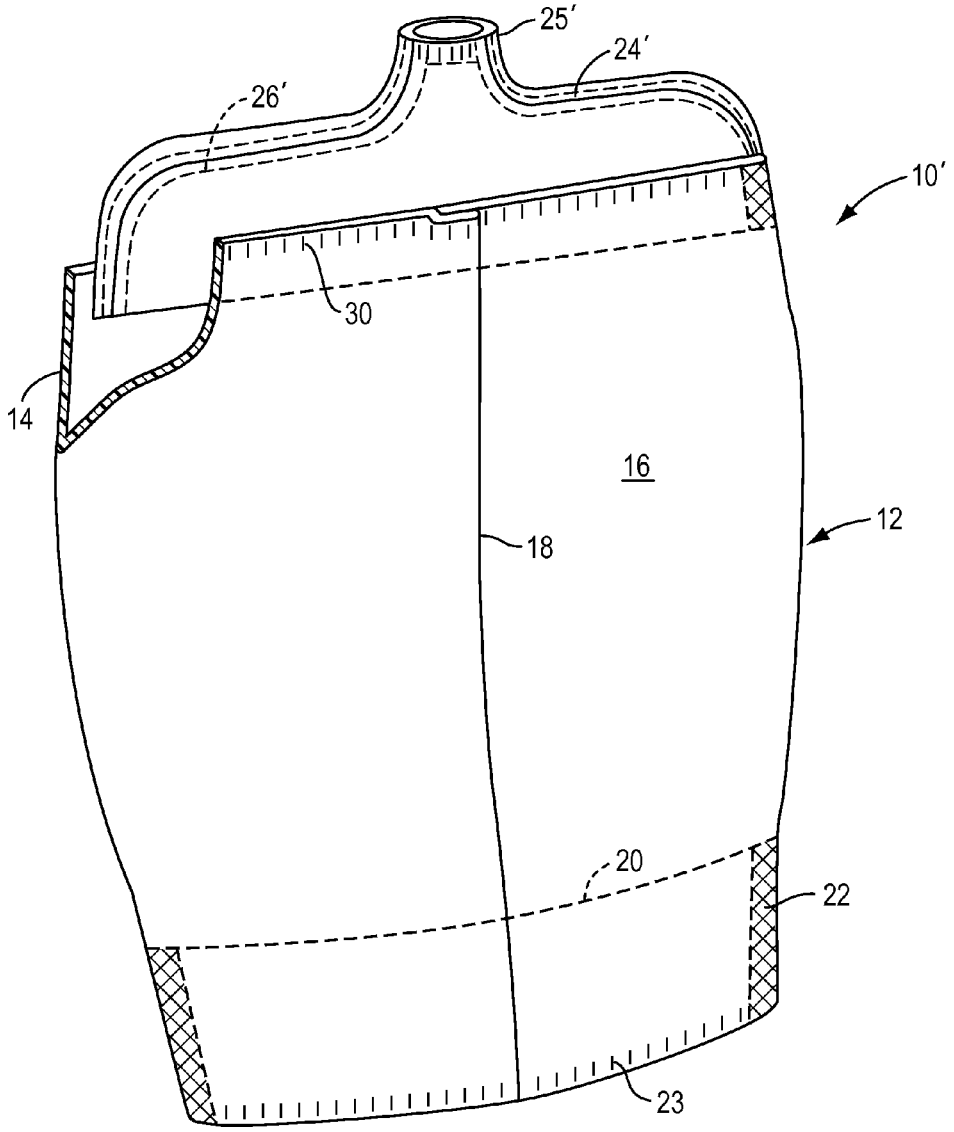
Figure 12:
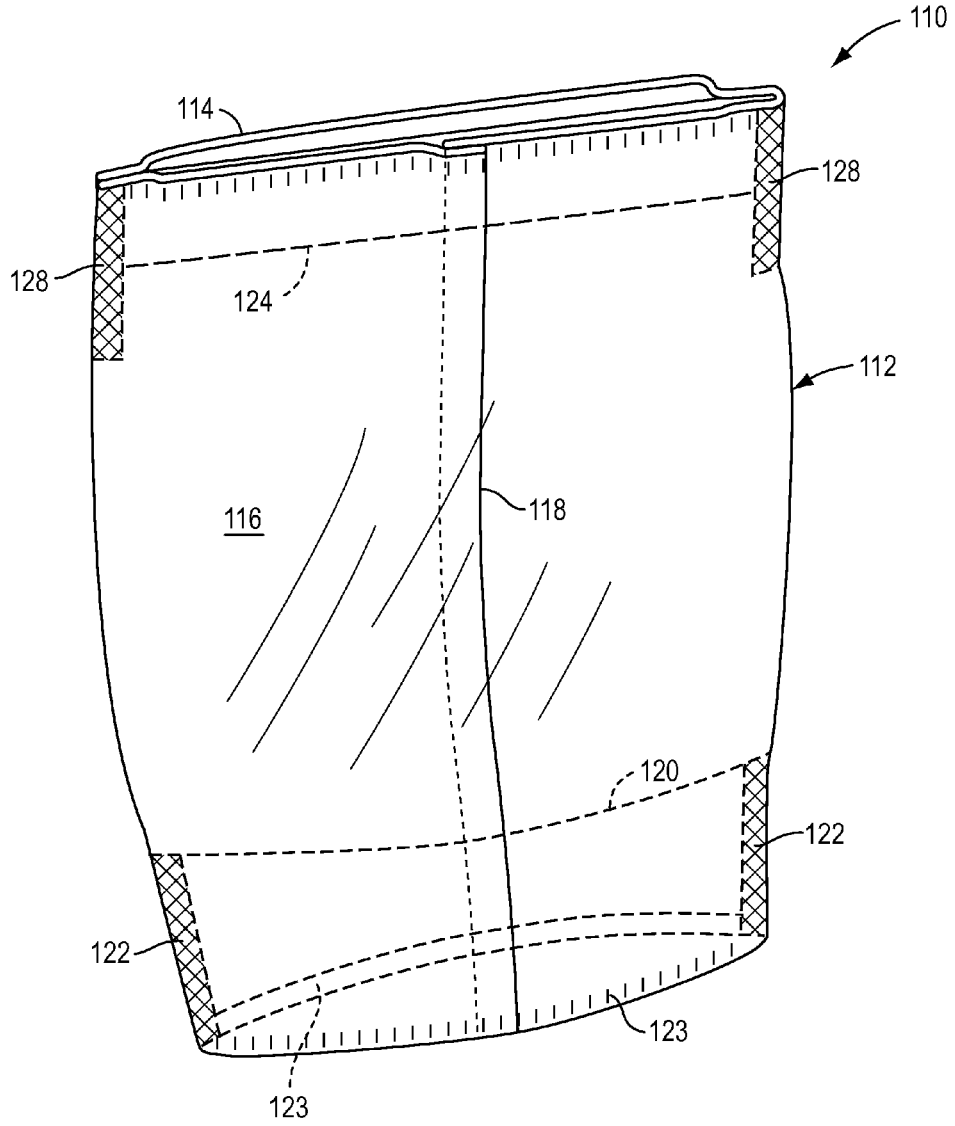
Figure 13:
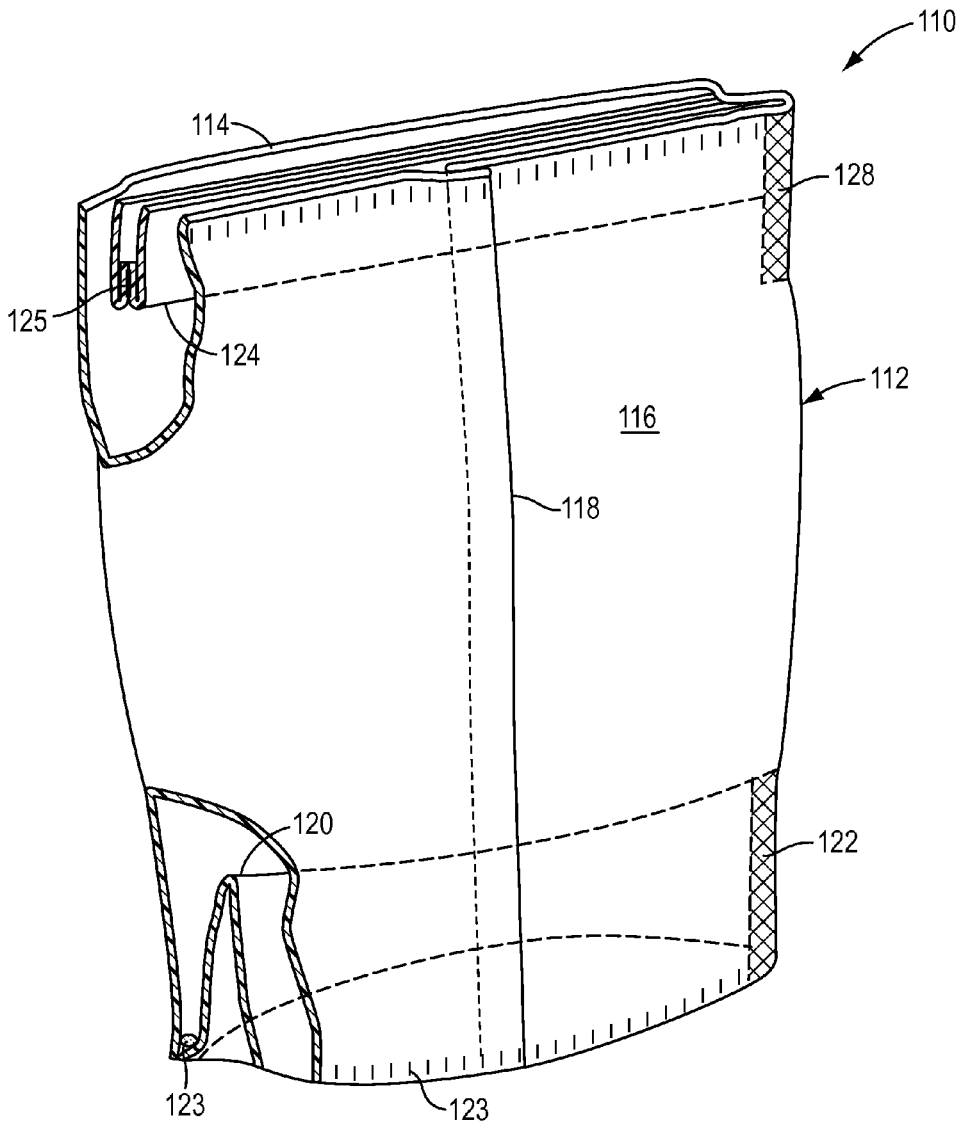
Figure 14:
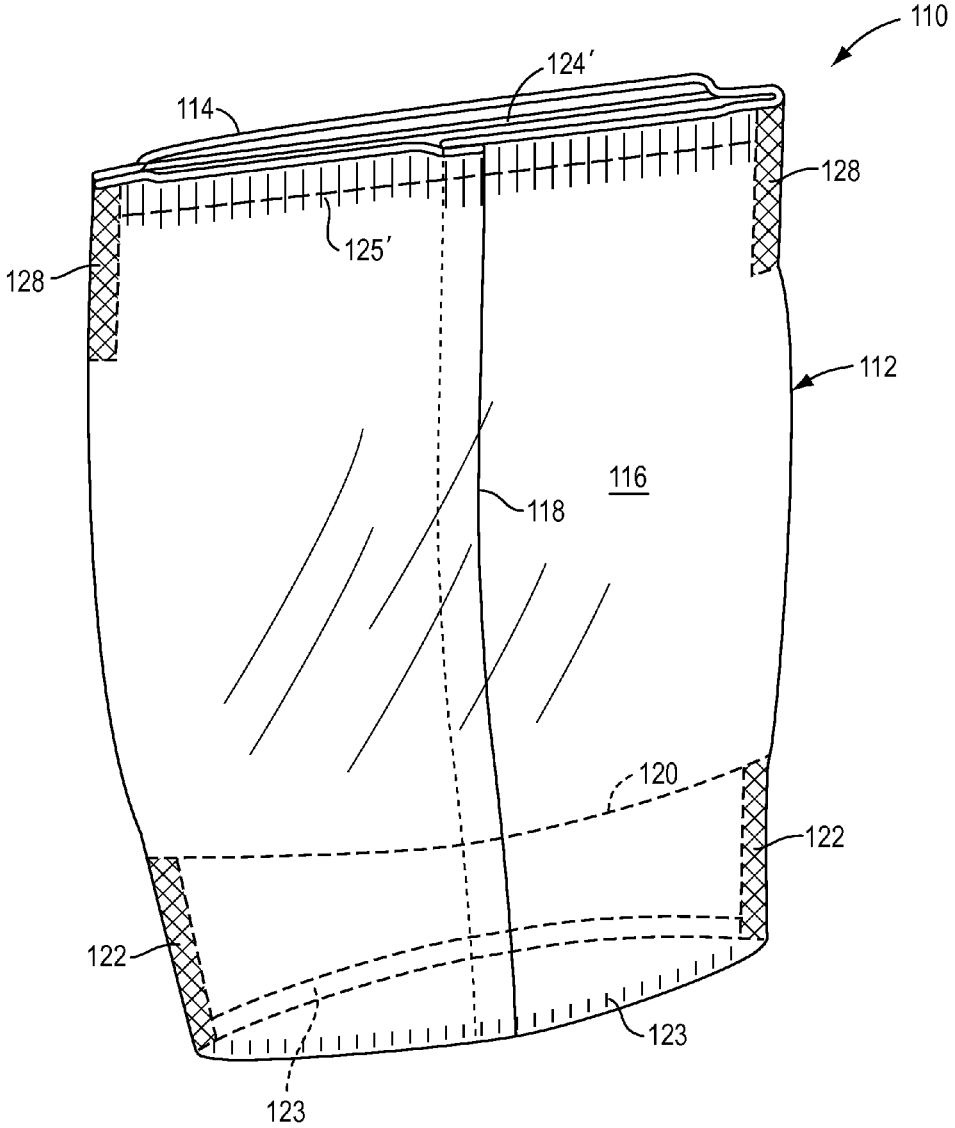
Figure 15:
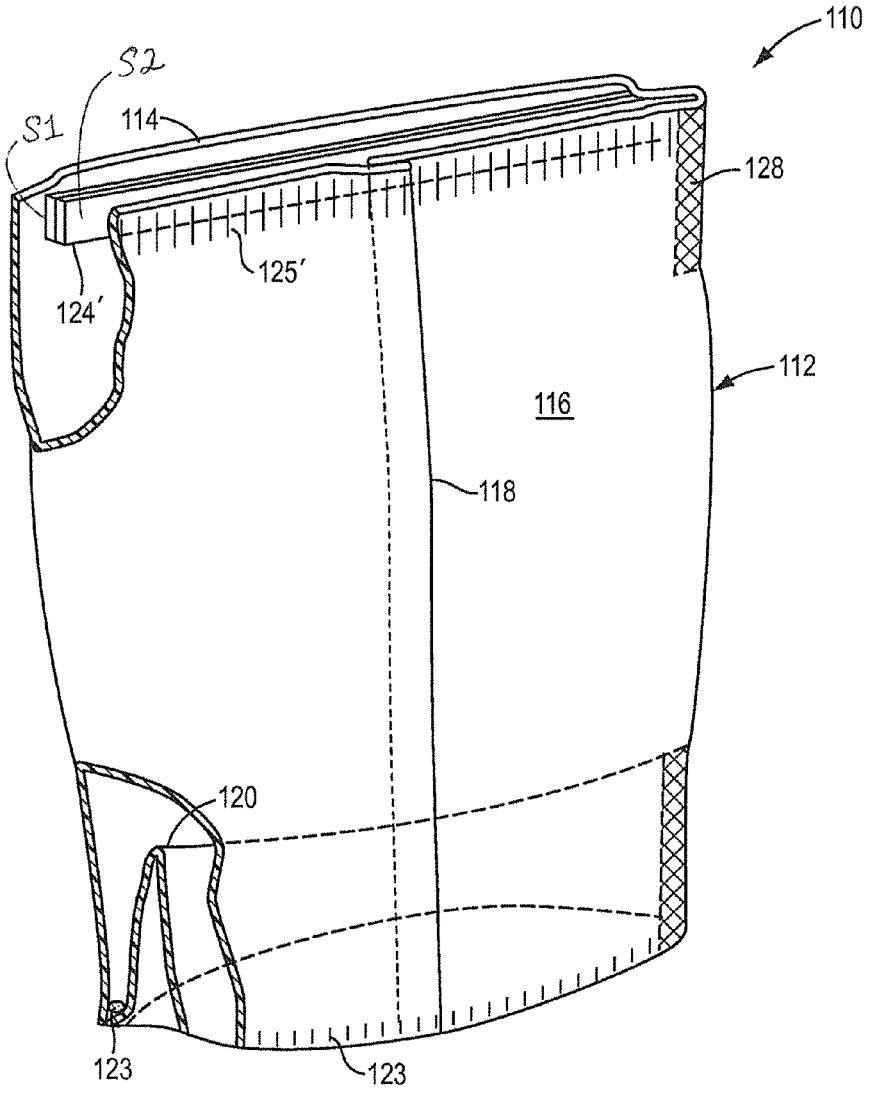

FIG. **6*a* is a cross-sectional view taken generally along lines 6*a*-6*a* of FIG. 5**;

FIG. **6*b* is a cross-sectional view taken generally along lines 6*b*-6*b* of FIG. 5**;

FIG. **6*c* is a cross-sectional view similar to FIG. 6**;

FIG. 7 is a diagrammatic view further illustrating formation of the present package, including cutting into individual packages;

FIG. 8 is a perspective view, partially cut away, of a further embodiment of a bottom-gusseted package, including an invertible dispensing spout, configured in accordance with the present invention;

FIG. 9 is a diagrammatic view illustrating formation of the bottom-gusseted package illustrated in FIG. 8;

FIG. 10 is a cross-sectional view taken generally along lines 10-10 of FIG. 9;

FIG. 11 is a perspective view, partially cut away, of the bottom-gusseted package of FIG. 8, wherein the dispensing spout of the package has been inverted outwardly for dispensing the contents of the package;

FIG. 12 is a perspective view of a further embodiment of a bottom-gusseted package, including an upper package seak, configured in accordance with the present invention;

FIG. 13 is a perspective view, partially cut away, of the embodiment of the bottom-gusseted package shown in FIG. 12;

FIG. 14 is a perspective view of a further embodiment of a bottom-gusseted package, including an upper package seak, configured in accordance with the present invention; and FIG. 15 is a perspective view, partially cut away, of the embodiment of the bottom-gusseted package shown in FIG. 14.

BRIEF DESCRIPTION OF THE DRAWINGS

While the present invention is susceptible of embodiment in various forms, there is shown in the drawings and will hereinafter be described the presently preferred embodiments, with the understanding that the present disclosure should be considered as an exemplification of the invention, and is not intended to limit the invention to the specific embodiments illustrated.

U.S. Pat. Nos. 4,909,017, 4,617,683, 5,902,047, 6,971,794, and 8,182,407, illustrate various package constructions and formation methods, and are all hereby incorporated by reference.

Figure 1:
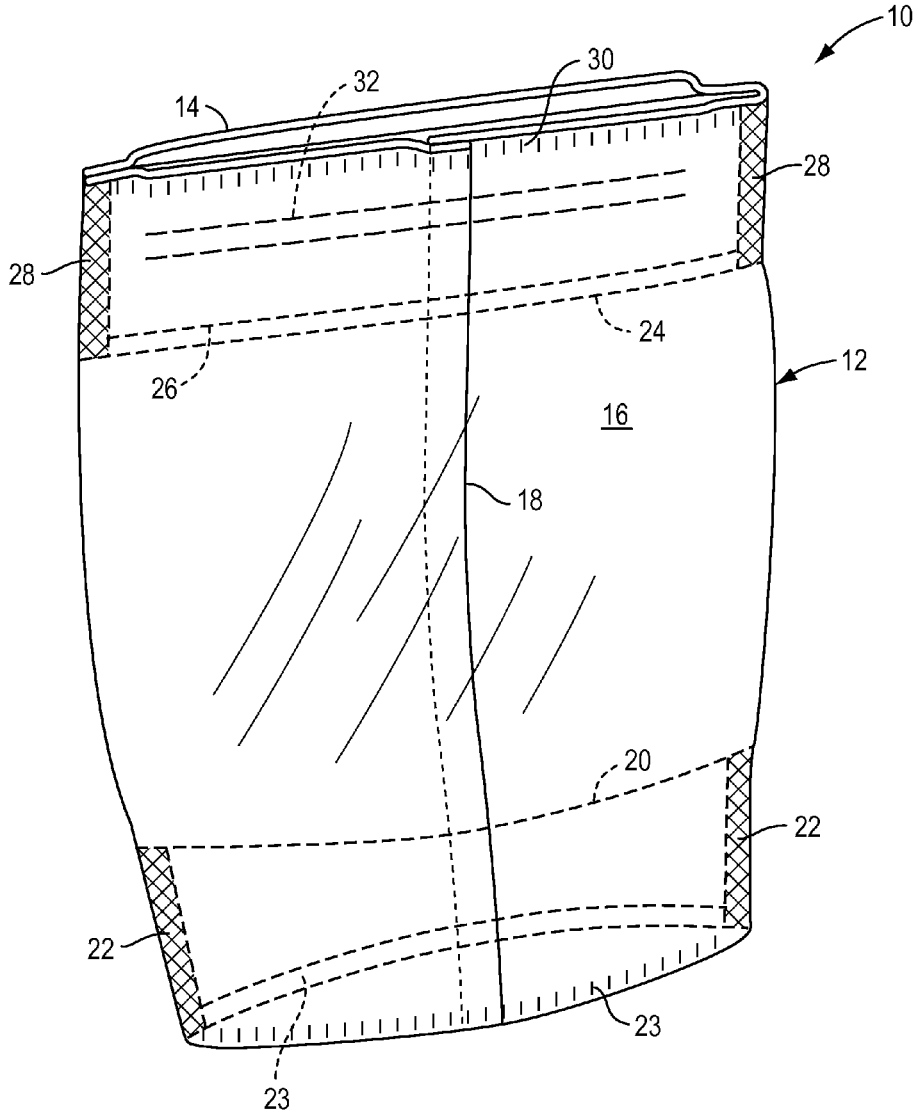
FIG. 1 is a perspective view of a bottom-gusseted package, configured as a recloseable package, embodying the principles of the present invention.
Figure 2:
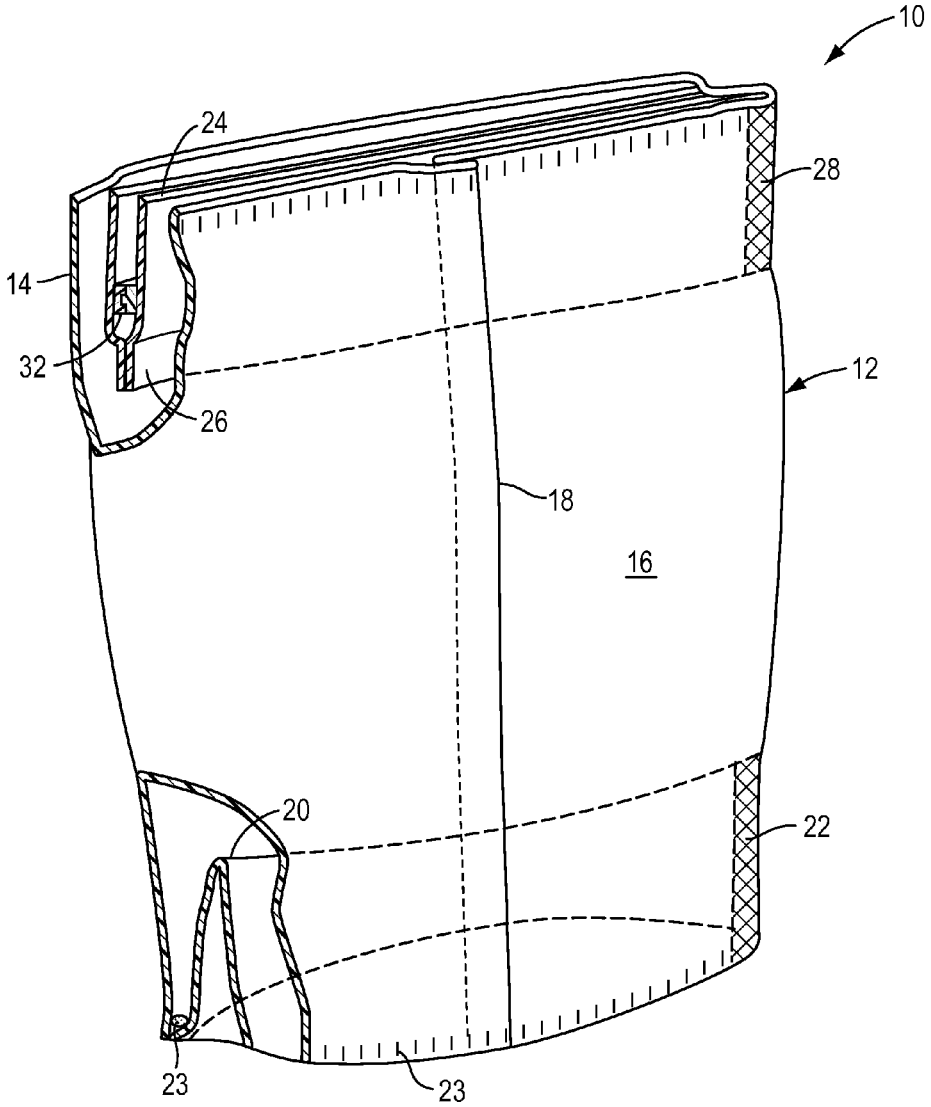
FIG. 2 is a perspective view similar to FIG. 1, with portions of the package cut away to illustrate the bottom gusset and recloseable fastener of the package.
Figure 3:
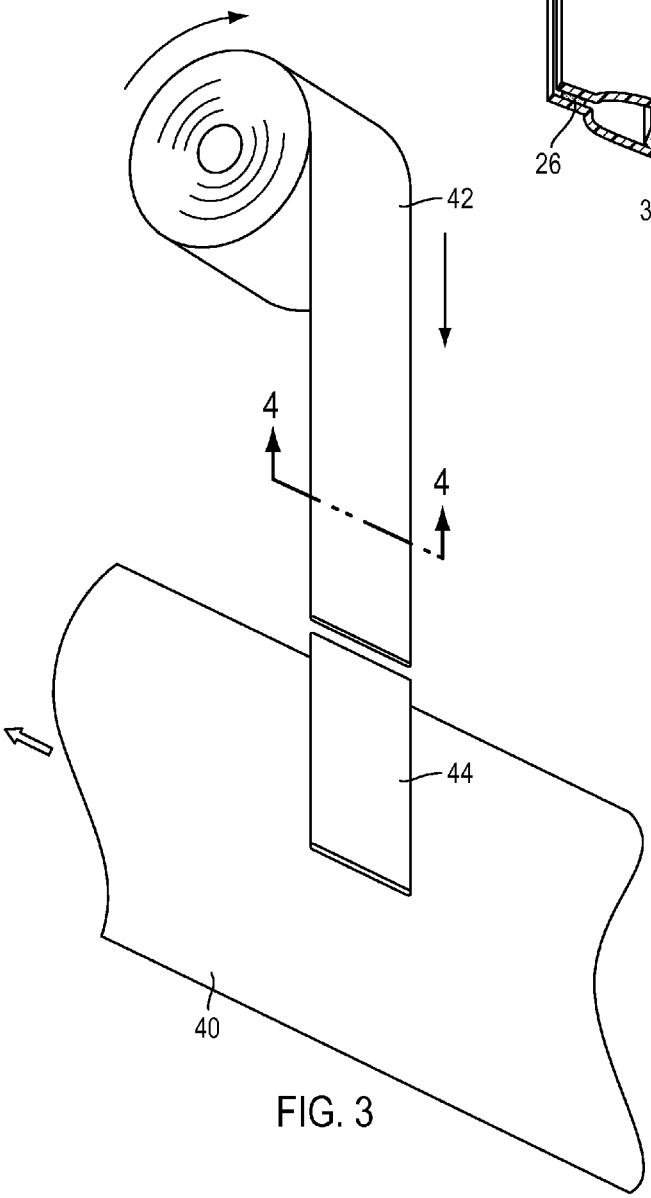
FIG. 3 is a diagrammatic view illustrating formation of the package shown in FIGS. 1 and 2, in accordance with the present invention.

With reference first to FIGS. 1 and 2, therein is illustrated a bottom-gusseted package 10 embodying the principles of the present invention. As will be further described, bottom-gusseted package 10 is configured as a recloseable package, and includes a recloseable fastener at an upper portion of the package. Notably, and as will be further described, package 10 is formed by joining a plurality of individual sleeves to an associated web of flexible material, in spaced apart relationship along the longitudinal axis of the flexible web. Attendant to package formation, each individual sleeve can be cut as individual packages are formed, with each individual sleeve providing a bottom gusset in one package, and a top sleeve portion, including a recloseable fastener, and/or other package features, in an adjacent one of the packages being formed. However, the present invention can be practiced without cutting of the individual sleeves, which are configured to provide a bottom gusset for each package being formed.

With further reference to FIGS. 1 and 2, the bottom-gusseted package 10 illustrated therein includes a package body 12 formed from a flexible film web having a longitudinal axis, wherein the flexible web has been folded to define a front package panel 14 (shown facing rearwardly in FIGS. 1 and 2) and a rear package panel 16 of the package body 12. The front and rear package panels 14 and 16 are joined to each other at respective lateral side margins of the package body 12. In the illustrated embodiment, the front and rear package panels are joined to each other where the flexible film web from which the body is formed has been folded. The flexible film web from which the package body 12 is formed is joined to itself along a longitudinal seam 18 which extends parallel to the longitudinal axis of the flexible web. While seam 18 has been illustrated generally at the middle of rear package panel 16, the flexible web can otherwise be joined to itself, such as at along one of the lateral side margins of the package body.

In accordance with the present invention, package 10 includes a bottom gusset 20 which is positioned between the front and rear package panels 14 and 16, and which extends upwardly and inwardly from lower edges of the front and rear package panels. As will be further described, the pleat-like bottom gusset 20 is formed from a sleeve of material which is positioned within the flexible web from which the package body is formed, with the sleeve of material cut attendant to formation of individual packages.

The bottom gusset 20 is joined to and integrated with the package body by a pair of side seals 22 at opposite lateral margins of the package body, and a pair of end seals 23 which respectively join the edges of the bottom gusset 20 to the front and rear package panels 14 and 16. It is presently contemplated that the bottom gusset 20 be configured to have a width less than that of the package 10, which permits the formation of side seals to join the front and rear package panels to each other. This permits the formation of a stable and self-standing package, by closing the opposite ends of the bottom gusset. This can be desirable if the inwardly facing surfaces of the bottom gusset do not heat-seal to each other.

In accordance with this illustrated embodiment, the bottom-gusseted package 10 is configured for recloseable use. To this end, the package 10 includes a top sleeve portion 24 positioned between the front and rear package panels 14 and 16, at the upper end of the package body 12. The top sleeve portion 24 preferably includes a sleeve seal 26, which may be configured as a so-called "peel seal", or otherwise configured for separation attendant to initial opening of the package. The top sleeve portion 24 can be otherwise configured to permit access to the contents of the package through the top sleeve portion, such as by the provision of a preferentially weakened region. The top sleeve portion 24 is joined to and integrated with the package body 12 by side seals 28 joining respective opposite ends of the sleeve portion 24 to the package body generally at opposite, lateral side margins thereof. A pair of top seals 30, respectively join the pair of legs or flanges of the top sleeve portion 24 to the front and rear package panels 14, 16.

In this embodiment, the top sleeve portion 24 includes a recloseable fastener 32. The recloseable fastener includes first and second fastener elements configured for releasable securement to each other, with the fastener elements respectively joined to the legs or flanges of the top sleeve portion 24. Thus, the sleeve portion 24 provides first and second mounting flanges for the first and second fastener elements, with the flanges respectively positioned inwardly of and joined to the front and rear package panels.

As will be appreciated, access to the contents of the package 10 is provided via the top sleeve portion 24 and recloseable fastener 32. For opening, the legs or flanges of the top sleeve portion 24 are separated, and the first and second fastener elements of the recloseable fastener 32 separated. For initial opening of the package, the sleeve seal 26 is opened and separated, with access to the interior of the package 10 thus provided. By merely pressing the sleeve portion 24 together, and urging the components of the recloseable fastener 32 together, the package 10 can be easily reclosed. As illustrated in FIGS. **6*a*-6*c*, for some applications in can be desirable to provide and an additional sleeve seal 27, positioned on the side of the fastener 32 generally opposite sleeve seal 26. Sleeve seal may also comprise a so-called "peal seal", and is eventually positioned between the mounting flanges for the fastener 32 provided by the opposite legs of the legs of the sleeve portion 24. Sleeve seal 27 can provide tamper-evidence to provide visually discernible evidence of the initial opening to the recloseable package 10**.

Recloseable fastener 32 preferably comprises a pair of interlocking profile fastener elements. Such fastener elements may be identically configured, or complementary. Adhesive fastener components, hook-and-loop fastener components, "unisex" self-engaging fastener components, or like recloseable fastening arrangements can be employed for the recloseable fastener 32.

For package formation, a flexible web 40 preferably comprising heat-sealable polymeric material is provided, with a flexible web typically advanced in a direction along its longitudinal axis web 40. Formation of the present bottom-gusseted package is further effected by providing a flexible, sleeve-forming web 42, also preferably comprising suitable polymeric, heat-sealable material. The composition of the sleeve-forming web can differ from the flexible web 40 for forming the package of the body, as may be desired. By way of example, the sleeve-forming material can be selected to exhibit certain gas permeability characteristics, or even be perforated, which can be desirable for some types of packaging. Perforated plastics allow gas exchange and prevent excess humidity, while solid plastics create a better product seal for modifying atmosphere and reducing available oxygen respiration and ripening, thus extending product shelf life.

It is presently contemplated that only one side of the sleeve-forming web be heat-sealable, so that the inside surface of the folded, sleeve-forming web does not heat seal to itself. This permits the eventual opening and spreading of the legs of the bottom gusset 20 so that the package 10 can assume a generally self-standing orientation.

Figure 4:
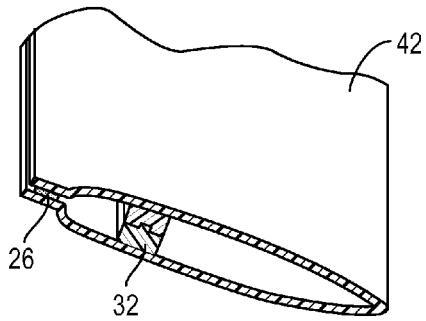
FIG. 4 is a cross-sectional view taken generally along lines 4-4 of FIG. 3.

As shown on FIG. 4, the sleeve-forming web 42 may be provided with a tubular configuration, including the sleeve seal 26 releasably joining lateral edges of the sleeve-forming web. In this embodiment, the sleeve-forming web is provided with recloseable fasteners 32, which may be provided in either continuous form, or as segmented, pre-cut lengths. As illustrated, the recloseable fastener elements are positioned generally within the sleeve-forming web 42, preferably in interconnected relationship.

Figure 6A:
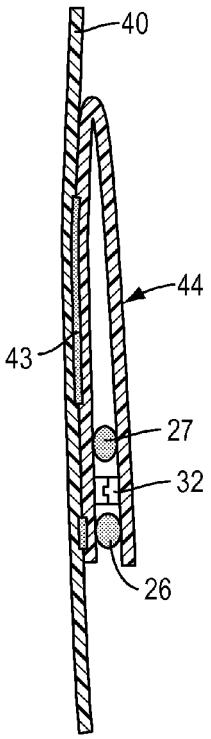
Figure 6B:
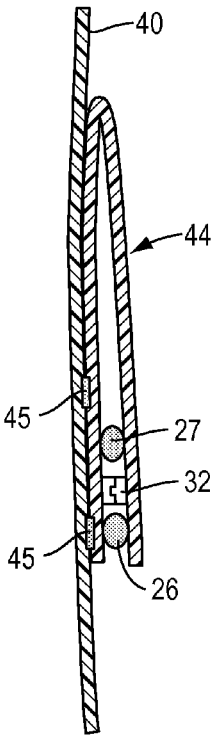

As further illustrated, individual sleeves 44 are cut from the sleeve-forming web 42, and are positioned transversely of the longitudinal axis of the flexible web 40 from which the package body is formed. For some applications, it can be desirable to seal the ends of each individual sleeve 44, such as with suitable adhesive. The individual sleeves 44 are joined to the flexible web 40 in spaced apart relationship longitudinally of the web 40. The spacing between the individual sleeves 44 corresponds to the length of each of the bottom-gusseted packages 10 being formed. The ends of each sleeve 44 are joined, such as by heat-sealing, to the web 40, by end seals 43 (FIG. 6*a*.) Transverse seals 45 can also be formed between the web 40 and the sleeve 44 extending generally parallel to fastener 32 along opposite side margins thereof (FIG. 6*b*.)

After each of the individual sleeves 44 is joined to the flexible web 40, the flexible web is folded and the lateral margins thereof joined together to form a folded flexible web (see FIGS. 5 and 6). In this way, a package body is formed for each of the bottom-gusseted packages. By folding of the flexible web 40, the front and rear package panels 14 and 16 of each package are formed. The folded flexible web 40 can be joined to itself so as to form bag seam 18, with the front and rear package panels joined to each other at the folded, lateral margins of the folded web. As illustrated, the individual sleeves 44 are positioned within the folded flexible web 40.

Notably, the present invention contemplates that each individual sleeve 44 spans and extends between two adjacent ones of the packages being formed, with subsequent cutting of the flexible web into individual packages resulting in each individual sleeve 44 providing a bottom gusset 20 for one package, and a top sleeve portion 24 for an adjacent one of the packages. FIG. 6 illustrates the manner in which each individual sleeve 44 extends between adjacent ones of the packages, with FIG. 7 illustrating cutting of the folded flexible web 40 transversely of its longitudinal axis to form individual packages, including cutting through each sleeve portion 44 to form a bottom gusset 20 for one package, and a top sleeve portion 24 for an adjacent package. It is presently contemplated that formation in this manner can be effected, if desired, during packaging on a form, fill, and seal machine, or that individual packages can be formed for subsequent filling. Depending upon the specific formation technique, side seals 22 and 28 are typically formed prior to filling, with one of end seals 23, 30 formed after the contents of each package have been positioned therein.

Figure 6C:
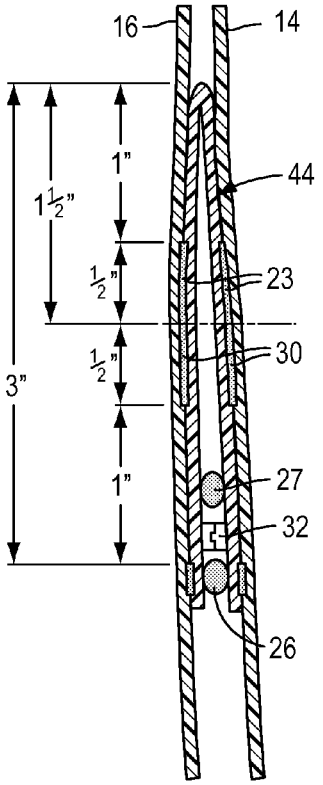

FIG. 6*c* illustrates an example of dimensioning of the bottom gusset of the present package, and the manner is which it is configured to accommodate the typical operating parameters of a vertical form, fill and seal machine. As will be recognized by those familiar with the art, this type of machine intermittently advances packaging material through the machine, with typical variation with respect to the web-cutting apparatus being plus/minus 0.25 inches. Thus, as shown in FIG. 6*a*, a typical sleeve portion 44 can be provided with a folded width of approximately 3 inches, with seals formed joining each sleeve portion 44 to the web 40. These seals would typically each have a 1.0 inch dimension. When the web is cut, the cut can be formed at the center of this 1.0 inch seal, so that seals each having a width of 0.5 inches are formed. However, because of the typical variation in the operation of the apparatus, i.e. plus/minus 0.25 inches, the exact dimensions of the bottom gusset 20 and top sleeve portion 24 can vary from one package to another. As will be appreciated, this dimensioning is meant to be illustrative, but it will be recognized that the present invention can readily be practiced to accommodate this typical cutting position variation of a vertical form, fill and seal machine.

With reference now to FIG. 8-11, therein is illustrated an alternate embodiment of the present bottom-gusseted package, designated 10'. In most respects, bottom-gusseted package 10' is like the previously-described embodiment, with the exception that the top sleeve portion 24' of each package is configured as an invertible dispensing spout. Thus, bottom-gusseted package 10' is particularly suited for packaging and dispensing liquid or semi-liquid products, such as beverages, condiments, or the like.

Formation of bottom-gusseted package 10' is illustrated in FIGS. 9 and 10, and is generally the same as the method of formation of previously-described package 10. A flexible web 40 of suitable polymeric material is advanced in a direction corresponding to the longitudinal axis of the web, with a flexible, sleeve-forming web 42' provided for providing individual sleeves 44'. Each individual sleeve 44' being formed is preferably configured to include a top sleeve portion 24' having a suitable spout portion 25', with each individual sleeve joined to itself along a suitable seal 26' to close the sleeve and form the spout portion.

As in the previous embodiment, the flexible, sleeve-forming web 42' is cut to form the individual sleeves 44', which are then joined to the flexible web 40 in spaced apart relationship longitudinally of the flexible web. Spacing between the individual sleeves corresponds to the length of each of the bottom-gusseted packages being formed.

After the flexible web 40 is joined to itself to form a tubular structure, with the individual sleeves 44' positioned therein, the assembled components are cut transversely of the longitudinal axis of the flexible web to form the individual packages 10'. As initially formed, the top sleeve portion 24' of each package, which forms the invertible dispensing spout, is positioned within the respective package body generally opposite the associated bottom gusset 20. The folded sleeve portion is preferably initially positioned within the package body so that the spout portion 25' thereof extends inwardly of the package generally toward the bottom gusset 20, as shown in FIG. 8. After filling of each package, the dispensing spout is invertible, such as by squeezing on the package and compressing its contents, so that the spout portion 25 extends generally outwardly of the package, as illustrated in FIG. 11, for dispensing the contents from within the package.

With reference now to FIG. 12-13, therein is illustrated a further alternate embodiment of the present bottom-gusseted package, designated 110. In most respects, bottom-gusseted package 110 is like the previously-described package 10, with the exception that the top sleeve portion 124 of each package is configured to provide an upper package seal instead of a recloseable fastener assembly. In this embodiment, elements corresponding to the previously described package 10 are designated by like reference numerals in the 100-series.

With further reference to FIGS. 12 and 13, the bottom-gusseted package 110 illustrated therein includes a package body 112 formed from a flexible film web having a longitudinal axis, wherein the flexible web has been folded to define a front package panel 114 (shown facing rearwardly in FIGS. 12 and 13) and a rear package panel 116 of the package body 112. The front and rear package panels 114 and 116 are joined to each other at respective lateral side margins of the package body 112. In the illustrated embodiment, the front and rear package panels are joined to each other where the flexible film web from which the body is formed has been folded. The flexible film web from which the package body 112 is formed is joined to itself along a longitudinal seam 118 which extends parallel to the longitudinal axis of the flexible web. While seam 118 has been illustrated generally at the middle of rear package panel 116, the flexible web can otherwise be joined to itself, such as at along one of the lateral side margins of the package body.

In accordance with the present invention, package 110 includes a bottom gusset 120 which is positioned between the front and rear package panels 114 and 116, and which extends upwardly and inwardly from lower edges of the front and rear package panels. As previously described, the pleat-like bottom gusset 120 is formed from a sleeve of material which is positioned within the flexible web from which the package body is formed, with the sleeve of material cut attendant to formation of individual packages.

The bottom gusset 120 is joined to and integrated with the package body by a pair of side seals 122 at opposite lateral margins of the package body, and a pair of end seals 123 which respectively join the edges of the bottom gusset 20 to the front and rear package panels 114 and 116.

The package 110 further includes a top sleeve portion 124 positioned between the front and rear package panels 114 and 116, at the upper end of the package body 112. The top sleeve portion 124 preferably is provided with an upper seal 125, preferably formed between inturned edges of the upper sleeve portion 124. This seal 125, may be configured as a so-called "peel seal", or otherwise configured for separation attendant to initial opening of the package. The top sleeve portion 124 can be otherwise configured to permit access to the contents of the package through the top sleeve portion, such as by the provision of a preferentially weakened region. The top sleeve portion 124 is joined to and integrated with the package body 112 by side seals 128 joining respective opposite ends of the sleeve portion 124 to the package body generally at opposite, lateral side margins thereof. A pair of top seals 130, respectively join the pair of legs or flanges of the top sleeve portion 124 to the front and rear package panels 114, 116.

FIGS. 14 and 15 illustrate a modified form of the embodiment of the present bottom-gusseted package illustrated in FIGS. 12 and 13. In this modified form of the package 110, the package includes a bottom gusset 120, but includes a modified top sleeve portion 124' which is positioned above an end seal 125' of the package formed by joining the front and rear package panels 114, 116 to each other. By virtue of the top sleeve portion having a width less than the width of the package, side seals 128 are provided at respective opposite ends of the sleeve portion 124'.

This form of the present package can be formed attendant to formation of a package having a bottom gusset, without the need to form a top gusset or other structure at the top of the package. Given the normal manufacturing variations noted above on a vertical form, fill and seal apparatus, formation of a packages with bottom gussets only could in some instances result in packages have a sleeve portion 124' such as illustrated in FIGS. 14 and 15. Specifically, in some instances, the individual sleeve forming the bottom gusset of the package would be positioned so that the sleeve would not be cut, and no portion of the sleeve would extend from the bottom gusset of one package to provide a sleeve portion of an adjacent package after cutting of individual packages. In other instances, the individual sleeve would be positioned so that cutting results in formation of the desired bottom gusset for one package, with a top sleeve portion such as 124' formed in an adjacent package. The top sleeve portion 124' consists of first and second elongate strips S1, S2 placed against each other between the front and rear panels 114, 116. Each of the strips S1, S2 is in the form of a single, flat layer. Each of the strips S1, S2 extends to the top of the front and rear panels 114, 116. The top sleeve portion 124' is confined generally within the end seal formed by side seals 128, and end seal 125' joining the front and rear package panels below the end of sleeve material that is in the top seal of the package.

By way of example, using the typical +/31 ¼" variation of the typical vertical form, fill and seal (VFFS) machine, if each package end seal is ¾", one extreme case would be that the gusset is only in the bottom of one package and no sleeve material in the top of the adjacent package. The other extreme would be having ½" of sleeve material, i.e., top sleeve portion 124', in the top of the adjacent package, but there still would be a ¼" end seal 125' below the sleeve material to seal off the top of the package. The end seal 125' extends: a) over a majority of the side-to-side dimension of the package; and b) over a location centrally between the lateral side margins of the package. The effect is that the top of the package would appear to not have any sleeve material in the top of any of the packages because the end seal would hide it.

From the foregoing, it will be observed that numerous modifications and variations can be effected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A package, comprising:

a package body formed from a flexible web having a longitudinal axis, said flexible web being folded to define a front package panel and a rear package panel of said package body, said front and rear package panels each having a top and bottom and being joined to each other at respective lateral side margins of said package body, said flexible web being joined to itself along a seam which extends parallel to said longitudinal axis of said flexible web;

a bottom gusset positioned between said front and rear package panels, and extending upwardly and inwardly from lower edges of said front and rear package panels, said package including a pair of laterally opposite side seals that join the front and rear package panels to each other at the respective lateral side margins of said package body, each of said side seals closing a respective end of said bottom gusset; and a top sleeve portion positioned between said front and rear package panels at an upper portion of said package, generally opposite said bottom gusset, and a heat seal forming an end seal joining said top sleeve portion to said front and rear package panels and joining said front and rear package panels below said top sleeve portion and extending to a location centrally between the lateral side margins of the package body, the top sleeve portion made up of first and second strips placed against each other and each extending to the tops of the front and rear package panels.

2. A package in accordance with claim 1, wherein said top sleeve portion is positioned between another pair of side seals.

3. A package in accordance with claim 1, wherein said bottom gusset and said top sleeve portion are formed from the same sleeve-making material, wherein an inside surface of said web of sleeve-making material does not heat-seal to itself.

4. The package in accordance with claim 1 wherein each of the first and second strips is in the form of a single, flat layer.

5. The package in accordance with claim 1 wherein the bottom gusset has a width less than a width of the front and rear package panels.

6. The package in accordance with claim 1 wherein the top sleeve portion is confined cooperatively by the end seal and laterally opposite side seals.

7. A package, comprising:

a package body formed from a flexible web having a longitudinal axis, said flexible web being folded to define a front package panel and a rear package panel of said package body, said front and rear package panels each having a top and bottom and being joined to each other at respective lateral side margins of said package body, said flexible web being joined to itself along a seam which extends parallel to said longitudinal axis of said flexible web;

a bottom gusset positioned between said front and rear package panels, and extending upwardly and inwardly from lower edges of said front and rear package panels, said package including a pair of laterally opposite side seals that join the front and rear package panels to each other at the respective lateral side margins of said package body, and a top sleeve portion positioned between said front and rear package panels at an upper portion of said package, generally opposite said bottom gusset, and a heat seal forming an end seal joining said top sleeve portion to said front and rear package panels and joining said front and rear package panels below said top sleeve portion and extending over a majority of a side-to-side dimension of the package body between the lateral side margins of the package body, the top sleeve portion made up of first and second strips placed against each other and each extending to the tops of the front and rear package panels.

8. A package in accordance with claim 7, wherein:

an inside surface of said bottom gusset does not heat-seal to itself.

9. A package in accordance with claim 7, wherein: said seam at which said web of material is joined to itself is positioned in said rear package panel.

10. The package in accordance with claim 7 wherein each of the first and second strips is in the form of a single, flat layer.

11. The package in accordance with claim 7 wherein said bottom gusset extends less than the width of the front and rear package panels.

12. The package in accordance with claim 7 wherein the top sleeve portion is confined cooperatively by the end seal and laterally opposite side seals.

* * * * *